US007311418B2

(12) United States Patent
Zeller et al.

(10) Patent No.: US 7,311,418 B2
(45) Date of Patent: Dec. 25, 2007

(54) BOOKLIGHT WITH RETRACTABLE CLIP AND LIGHT

(75) Inventors: Noel E. Zeller, Harrison, NY (US); Wei Young, Long Island City, NY (US)

(73) Assignee: Zelco Industries Inc., Mount Vernon, NY (US)

( * ) Notice: Subject to any disclaimer, the term of this patent is extended or adjusted under 35 U.S.C. 154(b) by 0 days.

(21) Appl. No.: 11/435,575

(22) Filed: May 16, 2006

(65) Prior Publication Data

US 2007/0268683 A1 Nov. 22, 2007

(51) Int. Cl.
*F21L 4/04* (2006.01)

(52) U.S. Cl. ..... 362/198; 362/98; 362/191

(58) Field of Classification Search ..... 362/98, 362/99, 187, 188, 190, 191, 196, 197, 198, 362/200, 205, 396
See application file for complete search history.

(56) References Cited

U.S. PATENT DOCUMENTS

| | | | | | |
|---|---|---|---|---|---|
| 1,363,698 | A | * | 12/1920 | Wacker | 362/200 |
| 1,826,864 | A | * | 10/1931 | Buchholz | 362/191 |
| 3,735,119 | A | * | 5/1973 | Williams, Jr. | 362/198 |
| 5,176,438 | A | * | 1/1993 | Fisherman | 362/99 |
| 5,884,888 | A | | 3/1999 | Grimes, III et al. | |
| 5,967,641 | A | * | 10/1999 | Sung et al. | 362/191 |
| D418,239 | S | | 12/1999 | Zeller | |
| 6,022,119 | A | | 2/2000 | Bolty, Jr. | |
| D423,130 | S | | 4/2000 | King | |
| 6,213,618 | B1 | | 4/2001 | Dobbin et al. | |
| D446,873 | S | | 8/2001 | Fisher et al. | |
| 6,361,184 | B1 | | 3/2002 | Hallgrimsson et al. | |
| 6,367,946 | B1 | | 4/2002 | Leifer et al. | |
| D464,755 | S | | 10/2002 | Harris et al. | |
| 6,491,408 | B1 | * | 12/2002 | Cooper et al. | 362/198 |
| 6,502,587 | B1 | | 1/2003 | Kellum et al. | |
| 6,533,431 | B2 | | 3/2003 | Leifer et al. | |
| 6,565,229 | B2 | * | 5/2003 | Bliss | 362/197 |
| D475,477 | S | | 6/2003 | Bennett, Jr. et al. | |
| 6,666,563 | B2 | | 12/2003 | Brown | |
| D486,260 | S | | 2/2004 | Christianson et al. | |
| 6,729,739 | B2 | | 5/2004 | Siegel et al. | |
| 6,736,531 | B2 | | 5/2004 | Wallach | |
| D498,322 | S | | 11/2004 | Schnell | |
| 6,851,825 | B2 | | 2/2005 | Marshall | |
| D507,673 | S | | 7/2005 | Martin | |
| D507,840 | S | | 7/2005 | Chan | |
| 6,951,403 | B2 | | 10/2005 | Bennett, Jr. | |

* cited by examiner

*Primary Examiner*—Y. My Quach-Lee
(74) *Attorney, Agent, or Firm*—William E. Pelton; Peter J. Phillips; Cooper & Dunham LLP

(57) ABSTRACT

A booklight comprises a housing having an elongated opening, a retractable arm having a proximal end and a distal end, and adapted to be telescopically received in said elongated opening, and slideable between a fully retracted position and a fully extended position, a light source mounted at the distal end of the retractable arm, and a clip on the housing adapted to mount the housing to a book.

10 Claims, 2 Drawing Sheets

BOOKLIGHT WITH RETRACTABLE CLIP AND LIGHT

FIELD OF THE INVENTION

This invention relates to a booklight, and more particularly to a booklight having a retractable light and clip in a single housing.

DESCRIPTION OF THE RELATED ART

Booklights have been developed to illuminate books and other reading material when ambient light is insufficient. For the most part, available booklights have an exposed light or light head, with a rigid or hinged shaft connecting the light head to a power source or housing. These arrangements expose the light or the light head to damage and render the device cumbersome to store or transport.

For example, U.S. Pat. No. 5,695,271 to Zeller shows a light which telescopes into an arm which is hinged to a mount bracket. The bracket is connected to a housing by a wire to connect power from a battery source in the housing to the light. Even when the light is fully telescoped, collapsed next to the bracket, the light head is exposed. The wire is also exposed and subject to stress and wear.

U.S. Pat. No. D507,840 shows a telescoping clip-on reading light having a housing and a telescoping arm with a light head at the top. Since it is located outside of the housing, the light head is exposed even when the arm is fully telescoped.

U.S. Pat. No. D423,130 shows a booklight having a housing, a light stem with a two part light shaft, and a light source at its tip. In the fully folded position, the shafts are entirely outside the housing, and the clip is always exposed.

The prior art does not appear to provide a booklight having a fully retractable light and clip arranged to retract in a single housing.

SUMMARY OF THE INVENTION

An object of the present invention is to overcome the problems associated with the above-noted devices.

In particular, an object of the present invention is to provide an unusually compact booklight in which the light and its associated wires are well protected from accidental damage.

Another object of the present invention is to provide a telescoping booklight which is compact with the light and clip retracted in a single housing when not in use.

Another object of the present invention is to provide a booklight that when deployed has exceptional utility and versatility.

According to the present invention, a booklight is provided comprising a housing having an elongated opening, a retractable arm having a proximal end and a distal end, and adapted to be telescopically received in said elongated opening and slideable between a fully retracted position and a fully extended position, a light source mounted at the distal end of the retractable arm, and a clip on the housing adapted to mount the housing to a book.

The present invention provides a booklight comprising an elongated housing having an elongated opening located within one side of the housing, and a battery receptacle located on a side of the housing spaced apart from said one side for receiving batteries, a retractable arm in the form of a flexible gooseneck having a proximal and distal end, said gooseneck being received in said elongated opening and slideable between a fully retracted position and a fully extended position, a light source mounted at the distal end of the retractable arm, a pair of contact rails operative for transferring energy from the batteries to the light source when the retractable arm is in a fully extended position or any position intermediate the fully extended position and a threshold extended position, a switch on the housing for connecting and disconnecting the batteries to the light source, a clip located on the housing between the elongated opening and the battery receptacle, said clip being moveable between a fully open position wherein it is adapted to mount to a spine of a book, and a fully retracted position wherein it is recessed into the housing, and a slide button on the housing operatively connected to the clip for moving the clip between the fully open and fully retracted position.

The present invention provides a light comprising a housing having an elongated opening, a retractable arm having a proximal end and a distal end, and adapted to be telescopically received in said elongated opening, and slideable between a fully received position and a fully extended position, a light source mounted at the distal end of the retractable arm, and a clip on the housing adapted to mount the housing to an object.

BRIEF DESCRIPTION OF THE DRAWINGS

A better understanding of the objects, features and advantages of the invention can be gained from a consideration of the following detailed description of the preferred embodiments thereof, in conjunction with the appended figures of the drawings, wherein a given reference character refers to the same or like element or part and wherein.

DETAILED DESCRIPTION OF THE PREFERRED EMBODIMENT

Figure 1:
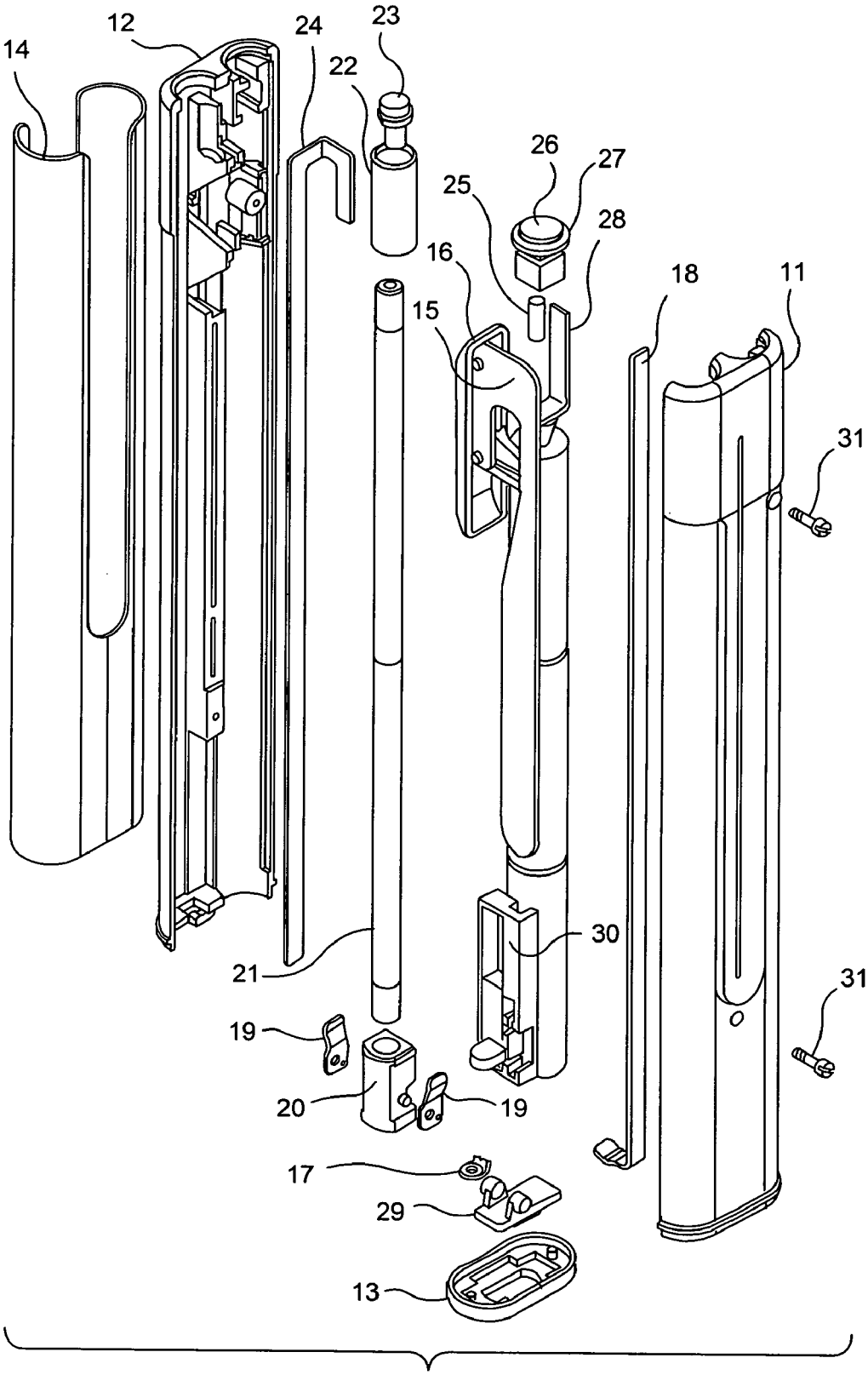
FIG. 1 is an exploded view of a folding booklight according to an embodiment of the invention.

According to the present invention, a booklight is provided, comprising a housing having an elongated opening, a retractable arm having a proximal end and a distal end, and adapted to be telescopically received in said elongated opening and slideable between a fully retracted position and a fully extended position, a light source mounted at the distal end of the retractable arm, and a clip on the housing adapted to mount the housing to a book.

The retractable arm may comprise a flexible gooseneck tube. The clip may be adapted to mount the housing to the spine of a book. The clip may be moveable between a fully open position wherein it is adapted to mount to a book, and a fully retracted position wherein it is recessed into the housing. The clip may be operatively connected to a slide button which moves the clip between the two positions. The housing may include a battery receptacle for receiving batteries, and a pair of contact rails operative for transferring energy from said batteries to the light source when the retractable arm is in any position between the fully extended position and a threshold extended position. The booklight may further include a switch on the housing for turning the light source on and off. The housing may be elongated, the elongated opening may be located within one side of the housing, a battery receptacle may be located within a side of the housing different from said one side, and the clip may be located between the elongated opening and the battery receptacle.

The present invention provides a booklight, comprising an elongated housing having an elongated opening located within one side of the housing, and a battery receptacle located on a side of the housing spaced apart from said one side for receiving batteries, a retractable arm in the form of a flexible gooseneck having a proximal and distal end, said gooseneck being received in said elongated opening and slideable between a fully retracted position and a fully extended position, a light source mounted at the distal end of the retractable arm, a pair of contact rails operative for transferring energy from the batteries to the light source when the retractable arm is in a fully extended position or any position intermediate the fully extended position and a threshold extended position, a switch on the housing for connecting and disconnecting the batteries to the light source, a clip located on the housing between the elongated opening and the battery receptacle, said clip being moveable between a fully open position wherein it is adapted to mount to a spine of a book, and a fully retracted position wherein it is recessed into the housing, and a slide button on the housing operatively connected to the clip for moving the clip between the fully open and fully retracted position.

The present invention provides a light comprising a housing having an elongated opening, a retractable arm having a proximal end and a distal end, and adapted to be telescopically received in said elongated opening, and slideable between a fully received position and a fully extended position, a light source mounted at the distal end of the retractable arm, and a clip on the housing adapted to mount the housing to an object.

The booklight described below and illustrated in the drawings is merely one embodiment of the invention. The invention can be embodied in many different structures.

The booklight shown in FIG. 1 comprises a housing 10 formed with a front housing part 11 and a rear housing part 12. A battery cover 13 is removeably attached to the bottom of the housing. The above parts may be made of plastic. A decorative inlay piece 14, which may be made of stainless steel, for example, surrounds the front and rear housing parts. The inlay piece 14 may be made of two or more parts, such as a front and a back, and may be attached to the front and rear housing parts by adhesive.

The booklight also has a clip 15, of stainless steel. The lower part of the clip 15 is adapted to protrude from a slot in the front housing part 11. A slide button 16 is exposed on the rear housing part 12 and attached to the clip 15 for actuating it. Sliding the slide button 16 upward protrudes the clip 15 from the housing, and sliding the button downward retracts the clip 15 into the housing. This is achieved by slots in the rear of the slide button 16 which receive pins in the clip 15 and by an inclined surface on the inside wall of rear housing part 12 which pushes the clip 15 away as the slide button 16 moves up and pulls the clip 15 in to retract inside the housing when the slide button 16 moves down. The slide button 16 moves vertically about ½" and the clip 15 moves horizontally about ½" during the full extent of their travel.

The battery cover 13 has an associated metallic battery cover contact 17, part of which is adapted to contact the terminal of a vertical stack of three size AAA batteries. The battery stack is also adapted to contact the lower part of a plus contact rail 18 which extends vertically through the inside of the housing. A pair of gooseneck contacts 19 is provided on gooseneck base 20. The gooseneck base 20 receives a gooseneck 21 at the top of which is an LED housing 22 and an LED 23. The LED 23 may comprise two or more individual lighting elements. A minus contact rail 24 runs, similarly to plus contact rail 18, vertically through the inside of the housing. When the gooseneck 21 slides up and down, its gooseneck base 20, through its gooseneck contacts 19, is engaged to slide against the minus contact rail 24 and plus contact rail 18. The plus contact rail 18 is connected to the positive terminal of the battery stack whenever the LED housing 22 extends at least partially out of the housing. The top of the minus contact rail 24 is connected to the negative terminal of the battery stack through a resistor 25, light switch 27, and switch battery contact 28. A light button 26 is provided on top of the switch 27. Repeated depression of the switch 27 causes the switch 27 to alternately open and close.

The battery cover 13 has a locking mechanism formed of a battery cover lock 29. The battery lock cover 29 will hold the battery cover in place on the housing when the cover is slid to one position, and will release the cover enabling access to the battery compartment when slid to its opposite position.

The gooseneck assembly has a spring release mechanism 30 at the bottom which is operative to lock the gooseneck 21 in the fully retracted position. Depressing the top of the gooseneck 21 will release the latch and enable one to pull out the gooseneck to a fully extended position or any intermediate position. The LED 23 at the top of the gooseneck is connected to the contact rails through wires or other means in the gooseneck.

When the housing is fully assembled, screws 31 hold the two housing halves in place.

Figure 2:
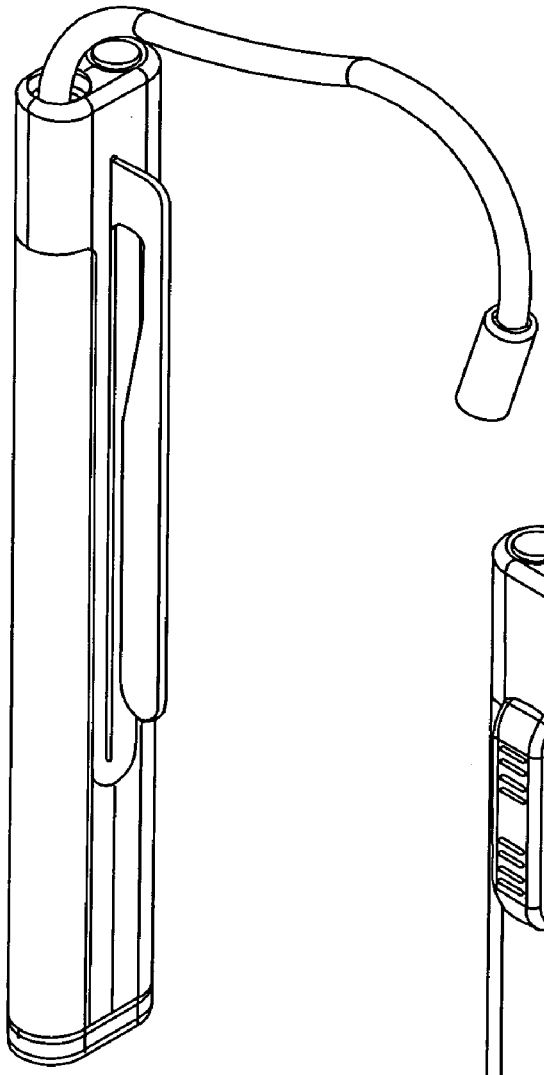
FIG. 2 is a perspective view of the booklight shown with a retractable arm fully extended and a clip fully extended.
Figure 3:
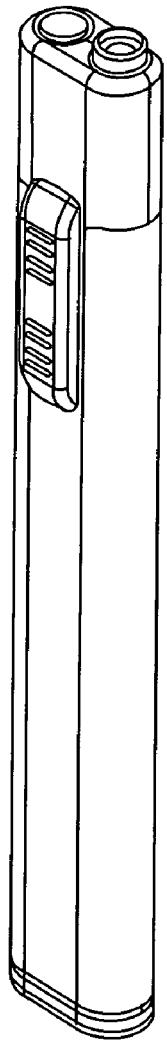
FIG. 3 is a perspective view similar to that of FIG. 2, but showing the retractable arm and clip fully retracted.
Figure 4:
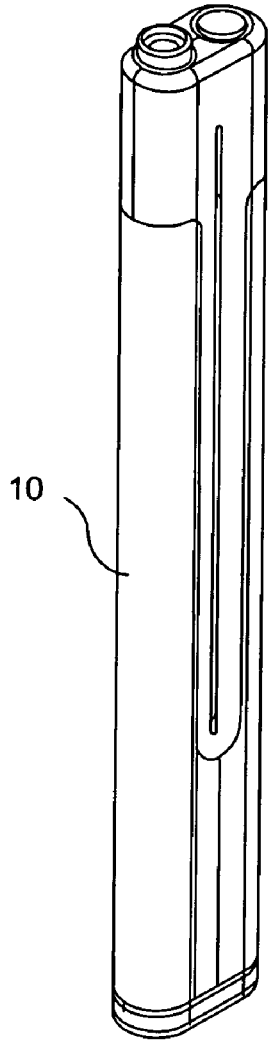
FIG. 4 is a perspective view of the side opposite that shown in FIG. 3, showing a slide button for extending and retracting the clip.

FIG. 2 is a perspective view of the booklight fully assembled and shows the clip in its fully extended position. The gooseneck is shown with its proximal end in the housing and its distal end fully extended. FIG. 3 shows the clip and gooseneck in their fully retracted positions. FIG. 4 shows the side opposite that shown in FIG. 3, with the slide button shown in its uppermost position, corresponding to retraction of the clip.

During operation, a user may simply depress the top of the gooseneck which will cause the gooseneck to be released so that it can be extended from the housing. When the LED 23 at the top of the gooseneck extends out of the housing a threshold amount of about ¾", the LED will illuminate, assuming the switch 27 is closed. Thus, one may keep the switch 27 in the closed position and simply use the gooseneck extension and retraction positions to turn the LED on and off, respectively, because the LED will not light if extended less than the threshold distance, even if the switch is closed. This enables the booklight to conserve battery power even if a user does not move the switch 27 to the off or open position.

The booklight may also be used as small flashlight with the clip either retracted or extended. If the clip is extended, the user may attach the booklight over his or her belt or other article of clothing, such as a shirt pocket, and manipulate the gooseneck to direct the light from the LED to the desired location. The top of the gooseneck may also be rotated through a range of motion of about 360°, so that the LED can be directed to virtually any location for use as a small flashlight.

The overall dimensions of the housing are about 7" high by ¼" wide by ½" thick, providing a very compact light while still providing a light source sufficient for reading or other uses. When fully extended, the length of the exposed gooseneck is about 5½".

The booklight may be provided with a case to protect it and its components during storage or transport, and may even be left in the case with the gooseneck extended to provide a light source while a user holds the outside of the case, further protecting the booklight during use.

Various modifications can be made to the embodiments of the present invention herein described without departing from the spirit thereof. The above description should not be construed as limiting the invention, but merely as exemplifications of preferred embodiments thereof. Those skilled in the art will envision other modifications within the scope and spirit of the present invention as defined by the claims appended hereto.

We claim:

1. A booklight comprising:

a housing having an elongated opening;

a retractable arm having a proximal end and a distal end, and adapted to be telescopically received in said elongated opening and slideable between a fully retracted position and a fully extended position;

a light source mounted at the distal end of the retractable arm; and a clip on the housing adapted to mount the housing to a book, wherein the clip is moveable between an open position and a retracted position recessed in the housing.

2. The booklight according to claim 1 wherein the retractable arm comprises a flexible gooseneck tube.

3. The booklight according to claim 1 wherein the clip is adapted to mount the housing to the spine of a book.

4. The booklight according to claim 1 wherein the clip is moveable between a fully open position wherein it is adapted to mount to a book, and a fully retracted position wherein it is fully recessed into the housing.

5. The booklight according to claim 1 wherein the clip is operatively connected to a slide button which moves the clip between the two positions.

6. The booklight according to claim 1 wherein the housing includes a battery receptacle for receiving batteries and a pair of contact rails operative for transferring energy from said batteries to the light source when the retractable arm is in any position between the fully extended position and a threshold extended position.

7. The booklight according to claim 1 further including a switch on the housing for turning the light source on and off.

8. The booklight according to claim 1 wherein the housing is elongated, the elongated opening is located within one side of the housing, a battery receptacle is located within a side of the housing spaced apart from said one side, and the clip is located between the elongated opening and the battery receptacle.

9. A booklight, comprising:

an elongated housing having an elongated opening located within one side of the housing, and a battery receptacle located on a side of the housing spaced part from said one side for receiving batteries;

a retractable arm in the form of a flexible gooseneck having a proximal and distal end, said gooseneck being received in said elongated opening and slideable between a fully retracted position and a fully extended position;

a light source mounted at the distal end of the retractable arm;

a pair of contact rails operative for transferring energy from the batteries to the light source when the retractable arm is in a fully extended position or any position intermediate the fully extended position and a threshold extended position;

a switch on the housing for connecting and disconnecting the batteries to the light source;

a clip located on the housing between the elongated opening and the battery receptacle, said clip being moveable between a fully open position wherein it is adapted to mount to a spine of a book, and a fully retracted position wherein it is recessed into the housing; and a slide button on the housing operatively connected to the clip for moving the clip between the fully open and fully retracted position.

10. A light comprising:

a housing having an elongated opening;

a retractable arm having a proximal end and a distal end, and adapted to be telescopically received in said elongated opening, and slideable between a fully received position and a fully extended position;

a light source mounted at the distal end of the retractable arm; and a clip on the housing adapted to mount the housing to an object, wherein the clip is moveable to an open position and a fully retracted position recessed into the housing.

* * * * *